United States Patent [19]

Helbig et al.

[11] Patent Number: 4,502,228

[45] Date of Patent: Mar. 5, 1985

[54] APPARATUS FOR DRYING PRINTED OR COATED WEBS

[75] Inventors: Helmut Helbig, Lengerich; Manfred Verlemann, Ibbenbünen, both of Fed. Rep. of Germany

[73] Assignee: Windmoller & Holscher, Lengerich, Fed. Rep. of Germany

[21] Appl. No.: 381,638

[22] Filed: May 24, 1982

[30] Foreign Application Priority Data

May 25, 1981 [DE] Fed. Rep. of Germany ..... 3120738

[51] Int. Cl.[3] ..... F26B 13/02

[52] U.S. Cl. ..... 34/47; 34/54; 34/211; 34/212; 34/242; 118/68

[58] Field of Search ..... 34/34, 32, 29, 54, 77, 34/211, 212, 47, 242; 118/58, 61, 68; 427/372.2, 398.4

[56] References Cited

U.S. PATENT DOCUMENTS

| | | | |
|---|---|---|---|
| 2,724,907 | 11/1955 | Walter . | |
| 4,087,923 | 5/1978 | Wilt, Jr. | 34/79 |
| 4,087,992 | 5/1978 | Sando et al. | 34/242 |
| 4,150,495 | 4/1979 | Stern | 34/54 |
| 4,233,901 | 11/1980 | Mallinson | 34/77 |
| 4,281,465 | 8/1981 | Zimmermann et al. | 34/54 |
| 4,343,096 | 8/1982 | Bergland | 34/77 |

FOREIGN PATENT DOCUMENTS 2150259 12/1973 Fed. Rep. of Germany .

*Primary Examiner*—Larry I. Schwartz

*Attorney, Agent, or Firm*—Fleit, Jacobson, Cohn & Price

[57] ABSTRACT

In the drying of printed or coated webs of moving material with the aid of heated air, the air is cycled through drying chambers or hoods until it is laden with solvents up to a predetermined value of saturation such as 50% of the lower explosion limit, whereafter it is extracted.

5 Claims, 4 Drawing Figures

APPARATUS FOR DRYING PRINTED OR COATED WEBS

The invention relates to a method of drying printed or coated webs, wherein the web running through drying chambers or covered by drying hoods is swept by heated air part of which is cycled until reaching the desired concentration of solvent and a part of which is continuously introduced as fresh air, and wherein the air withdrawn from the cycle and having the desired solvent concentration is fed to an after-burner or a recovery plant, and to an apparatus for performing this method.

The output of printing presses depends very much on the speed with which the printed webs can be dried, so that the attainable printing capacity depends more on the drying speed than on the maximum speed of the printing press. The drying capacity can be increased by increasing the temperature of the drying air, with which the saturation limit increases, and by increasing the throughput of air. The temperature of the drying air must, however, be kept below values at which the material could be damaged or shrink and the air throughput can likewise not be increased at will because the circulation and heating of large amounts of air gives rise to considerable costs.

Other limitations are imposed by legal provisions for exhaust air, which permit a maximum solvent concentration of 0.3 g/m$^3$ for drying air exhausted into the atmosphere, the solvent usually being ethanol, A-glycol, E-acetate or toluene. The highest legally permissible concentrations of solvents in the exhausted air with respect to protection against explosion are, however, not generally reached at present so that solvent concentrations up to 10 g/m$^3$ and higher are unofficially tolerated. If the legal requirements were to be complied with, purifying installations would become necessary of which the costs would reach the costs of the printing presses themselves because of the large amounts of exhausted air to be cleaned.

It is the problem of the invention to provide a drying method which gives rise to only such little exhaust air to be cleaned that purification plant can be installed at viable costs.

According to the invention, this problem is solved in that the air is cycled until it has become enriched with solvents up to a predetermined value, e.g. 0.5 of the lower explosion limit, and is only then withdrawn. Regulations for explosion safeguards permit solvent concentrations up to 0.5 of the lower explosion limit and these are over one hundred times the legally permissible solvent concentrations of exhausted air which is discharged into the atmosphere. For example, at temperatures above 50°, the solvent concentration corresponding to 0.5 of the lower explosion limit is still far below the saturation limit for solvent in the drying air, so that the drying properties of the cycled drying air are not markedly influenced up to a degree of concentration corresponding to 0.5 of the lower explosion limit. According to the method of the invention, the drying air is thus laden with solvents up to the maximum concentration permitted by the regulations for explosion protection, so that the drying air is utilised to the maximum extent for drying purposes and the least possible amounts of exhaust air have to be passed to downstream purification plant.

Example for Flexographic Printing Presses

In flexographic printing machines, it is necessary to perform drying between the individual inking units so that the inks are at least so dry that the next colour can be applied without the danger of smearing or the colours running into each other. Apart from such inter-unit drying, provision must be made for so-called bridge drying from which the web runs through a drying chamber. Hitherto, it was usual to provide independent drying air cycles for intermediate inking unit drying and for bridge drying. In one embodiment of the invention it is provided that the air is cycled successively through the drying chamber of the bridge and at least a portion of it through the drying hoods of the individual printing units, and the false air entering in the region of the inlet slots and possibly also the outlet slots of the drying chamber or drying hoods is extracted. By reason of the fact that the inking unit drying and the bridge drying are connected in series in one drying air cycle, one can not only reduce the amount of cycled air but it is also charged with solvents twice during each circulation so that the desired high solvent concentrations can be reached earlier. The desired high solvent concentrations can, however, be reached only if the entry of false air is minimised to such an extent that the drying air will not be diluted to below the desired high concentration. Since the inlet and outlet slots for the web cannot be reduced at will because the web flutters, the false air must be sucked away to prevent its entry into the slots regions. Even so, one cannot prevent the continuous increase of cycled drying air owing to the entry of false air. A certain amount of air must therefore be constantly removed from the cycle by way of the mixing chamber such as that known from DE-AS No. 12 62 296. The cycle can be set so that the air withdrawn from the mixing chamber possesses the desired high concentration whilst the cycled air is kept just at the permissible concentration through the entry of additional air and false air. It is also possible to withdraw all or part of the cycled air after it has been enriched to the highest permissible concentration and to replace it with fresh air.

An apparatus for performing the method of the invention comprising a mixing chamber, at least one circulating fan and at least one heating chamber is characterised according to the invention in that the drying chamber of the bridge, the parallel drying hoods of the individual printing units, the mixing chamber, the circulating fan and the heating chamber are connected in series by pipes. The inlet and outlet slots of the drying chamber and drying hoods are desirably surrounded by peripheral suction seals. Further, bypass conduits may be provided for partially bridging the drying hoods of the printing units because the amount of air required for intermediate inking unit drying is usually less than that for bridge drying.

One example of the invention will be described in more detail with reference to the drawing, wherein.

Figure 1:
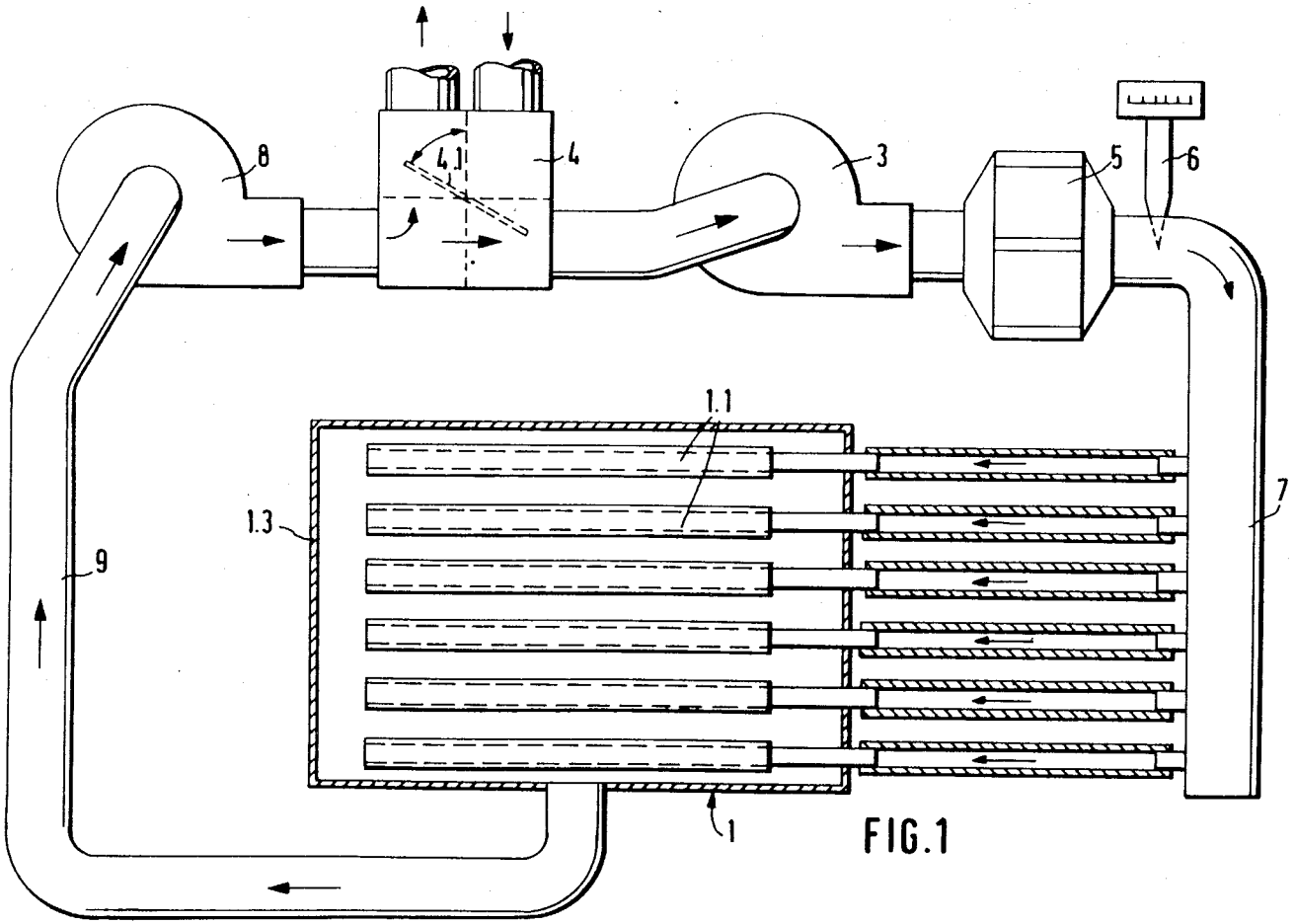
FIG. 1 is a diagrammatic representation of the cycle for bridge drying.

The bridge drying apparatus is designated 1 and the printing unit drying apparatus is designated 2. By means of a fan 3, fresh air is sucked in by way of a mixing chamber 4 such as that known from DE-AS No. 12 62 296, heated in a heating chamber 5 and measured by a thermometer 6, and, by way of a distributing pipe 7, fed to the individual slot nozzles 1.1 of the bridge 1 or the individual slot blowers 2.2 of the printing unit drying apparatus 2. From there, the hot air laden with solvents is, together with leakage air sucked in from the side of the printed web, extracted by a fan 8 out of the drying chambers, hoods or boxes 1.3 or 2.3 through a common suction conduit 9 and fed to the mixing chamber 4 where, depending on the setting of the adjustable flap 4.1, it is either released to atmosphere or returned to the drying process together with fresh air.

Figure 3:
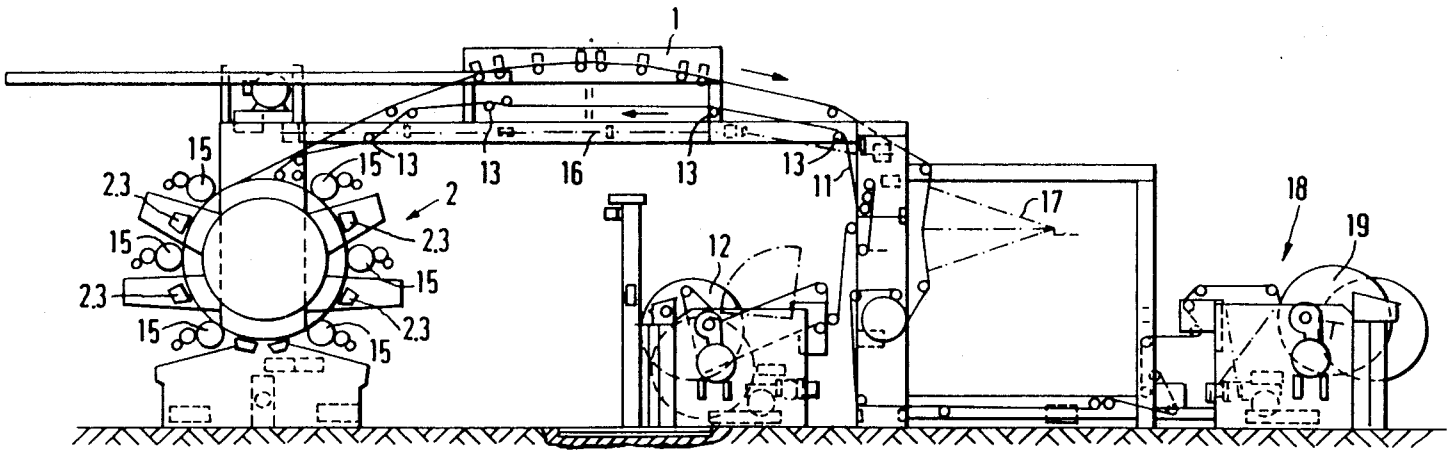
FIG. 3 is a diagrammatic side elevation of the flexographic printing machine.

FIG. 3 shows the arrangement of the bridge 1 and drying hoods or boxes 2.3 on the printing mechanism. The drying process will now be explained in relation to the movement of the printed web. The web 11 is withdrawn from a storage reel 12 and fed over guide rollers 13 to the printing mechanism 14 where it is printed by the individual printing cylinders 15. Between the individual printing cylinders 15 there are drying boxes 2.3 in which hot air is blown onto the freshly printed web 11. The web is then fed to the drying chamber or box 1.3 on the bridge 16 where the remaining solvents are extracted from the web 11 by blowing hot air thereon. The web then reaches the winding station 18 by way of a printing monitoring station 17 and is coiled to form a supply reel 19.

However, in the case of the intermediate inking unit and bridge drying as described with reference to FIGS. 1 and 2, an increase of the solvent concentration up to a value corresponding to 0.5 of the lower explosion limit is impossible because of the large amounts of air that are necessarily required for the two cycles.

Figure 2:
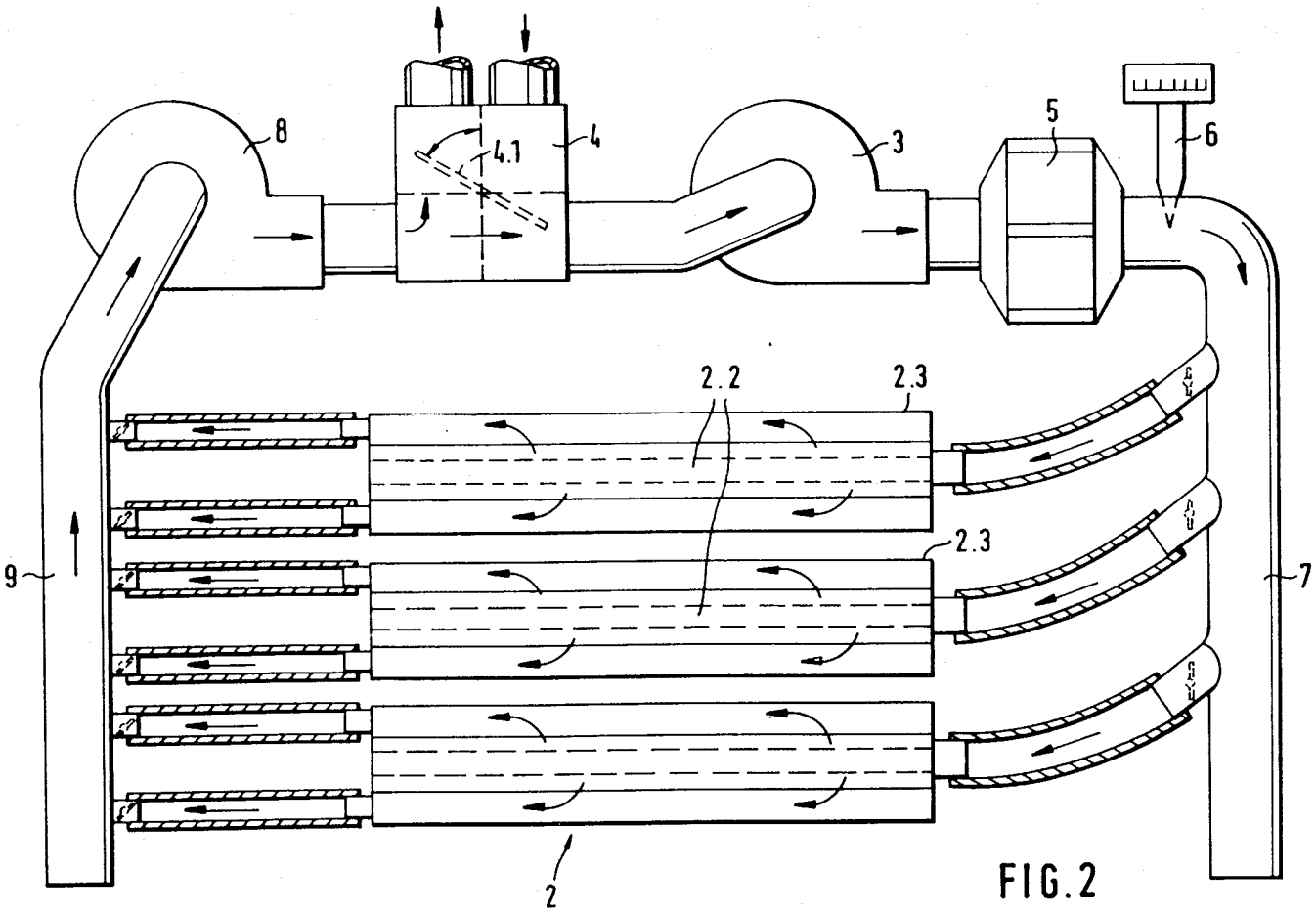
FIG. 2 is a diagrammatic representation of the cycle for intermediate inking unit drying.

To achieve the desired high solvent concentration of the drying air, the two known cycles described with reference to FIGS. 1 and 2 are connected in series in the manner shown in FIG. 4. This permits the air circulated per unit time to be reduced for example from 200 $m^3$/min to 100 $m^3$/min.

Figure 4:
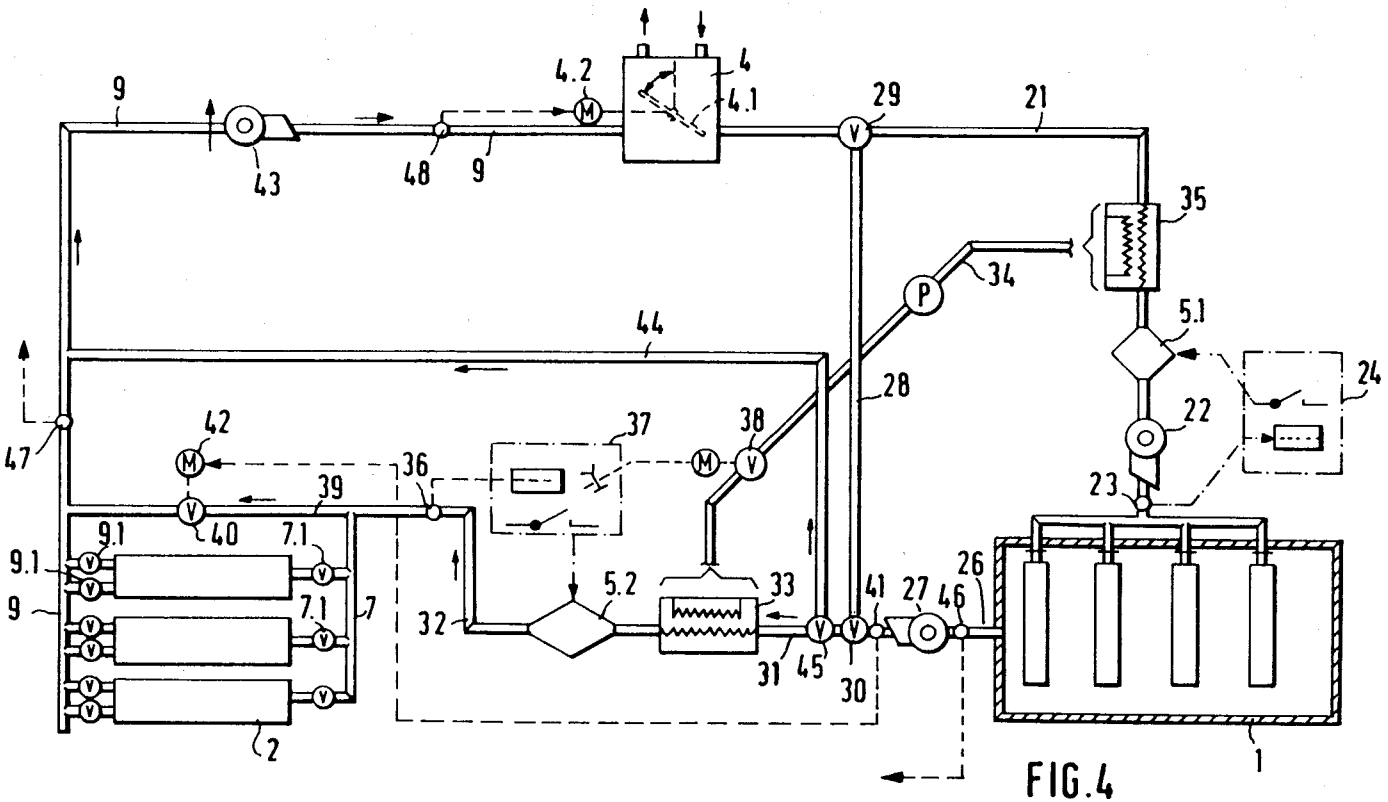
FIG. 4 is a diagrammatic representation of the drying cycle in which the intermediate inking unit drying and bridge drying are connected behind each other.

In the series circuit of FIG. 4, air is sucked through a single mixing chamber 4 by way of a conduit 21 by a fan 22 and preheated in a heating chamber 5.1 which is controlled by means of a temperature sensor 23 and an associated control device 24. The hot air reaches the drying box 1.3 of the bridge 1 and is then passed together with the leakage air through a suction conduit 26 by means of a fan 27 and fed to the drying boxes 2.3 on the printing mechanism by conduits 31, 32. If less drying is required at the printing mechanism than at the bridge 1, the drying at the printing mechanism can be partially bypassed through a bypass 28. Flaps 29, 30 are provided to operate the bypass 28.

The air may be heated further by a further heating chamber 5.2 if this is necessary. A heat exchanger 33 in the conduit 31, 32 dissipates its heat by way of a conduit 34 to a heat exchanger 35 disposed in the conduit 21. This reduces the heating energy required in the heating chamber 5.1. In the conduit 32 there is a temperature sensor 36 from which the signal is processed in a control device 37 which either feeds current to the heating chamber 5.2 or actuates a valve 38 in the conduit 34, depending on whether the printing mechanism 2 is to receive warmer or cooler air. The hot air passes from the conduit 32 to the drying boxes 2.3 arranged on the printing mechanism, it being possible to shut each box 2.3 individually by means of adjustable flaps 7.1 or 9.1. The additional air can, however, also be fed through a bypass 39 containing an adjustable flap 40, thereby bypassing the drying boxes 2.3 partly or completely and reaching the suction conduit 9 directly. Behind the fan 27 there is a pressure gauge 41 for influencing the servo-motor 42 which moves the adjustable flap 40. The conduit 9 contains a fan 43 which extracts the air to be cycled from the drying boxes 2.3 on the printing mechanism and passes it to the mixing chamber 4. A bypass 44 branching off from the conduit 31 leads to the conduit 9 into which it opens in front of the fan 43. Flow through the bypass 44 can be regulated by an adjustable flap 45.

The flap 4.1 of the mixing chamber 4 is controllable by a servo-motor 4.2. A respective measuring device 46, 47, 48 for measuring the solvent concentration of the hot air circulating in the conduits is provided in the conduit 26 in front of the fan 27, in the conduit 9 between the bypasses 39 and 44 as well as behind the fan 43. The readings from the measuring devices 46 to 48 are processed in an electric control (not shown) and transformed into control pulses for the servo-motor 4.2. The measuring devices 46 to 48 operate continuously and can be set to the organic solvents that are being used. Their control signals can be set to a percentage of the lower explosion limit, preferably 50% with the current safety regulations. If the flap 4.1 is already fully open or cannot be opened any further because it is jammed or because of some other obstacle, the associated electric control (not shown) contains an output electrically connected to the main drive of the printing press to reduce the speed of the press until the selected set maximum permissible concentration has again been achieved. The measuring devices 46 to 48 are equipped with self-monitoring means, i.e. appropriate safety measures are taken upon failure of the concentration control, for example opening of the control flap 4.1 or reduction of the machine speed.

We claim:

1. An apparatus for drying printed or coated webs in a series-connected drying cycle, the apparatus comprising:

a bridge dryer mounted on a bridge between a printing press and a take-up roller for final drying of the printed or coated webs, the bridge dryer including a drying chamber into which the webs and heated air are introduced, the drying chamber having inlet and outlet slots for passage of the webs therethrough and having means for blowing heated air onto the webs as the webs pass through the chamber to thereby dry the webs by removing solvent therefrom;

a plurality of individual printing unit dryers mounted among printing units of a printing press having a plurality of printing units for drying the printed or coated webs after contact thereof with each printing unit, each printing unit dryer including a drying hood into which the webs and heated air are introduced, each drying hood having inlet and outlet slots for passage of the webs therethrough and having means for blowing heated air onto the webs as the webs pass through the drying hood to thereby dry the webs by removing solvent therefrom, wherein the drying hoods are fluidly connected in parallel by fluid connection means such that heated air circulated from the bridge dryer is introduced and flows therethrough in parallel;

a mixing chamber in communication with ambient air for receiving and recirculating the solvent-laden air from the dryers, for discharging solvent-laden air after a predetermined solvent concentration has been reached, and for the continuous introduction of ambient air;

a heating chamber for receiving air from the mixing chamber and for heating the air to a predetermined temperature; and a circulating fan for sucking heated air from the heating chamber and for circulating the heated air to the bridge dryer.

2. An apparatus according to claim 1, wherein at least the inlet slots of the drying chamber of the bridge dryer and the inlet slots of each drying hood of the plurality of individual printing unit dryers are each surrounded by a peripheral suction seal for sucking away ambient air to prevent entry thereof through the slot and into the dryer.

3. An apparatus according to claim 1, wherein the apparatus further comprises a plurality of bypass conduits for partially bridging the drying hoods of the plurality of individual printing unit dryers and for circulating at least a portion of the heated air from the bridge dryer to one of the mixing chamber and the heating chamber.

4. An apparatus according to claim 1, wherein the fluid connection means comprise conduits.

5. An apparatus according to claim 1, wherein the fluid connection means comprise pipes.

* * * * *